US005822918A

United States Patent [19]

Helfman et al.

[11] Patent Number: 5,822,918

[45] Date of Patent: Oct. 20, 1998

[54] PLANTER

[75] Inventors: Barbara Helfman, 3109 Shadow Hill, Middletown, Ohio 45042; James M. Weisberg, West Chester, Ohio

[73] Assignee: Barbara Helfman, Middletown, Ohio

[21] Appl. No.: 755,585

[22] Filed: Nov. 25, 1996

[51] Int. Cl.[6] ..... A47G 7/02

[52] U.S. Cl. ..... 47/39; 248/231.41; 47/40

[58] Field of Search ..... 248/231.4; 47/39, 47/40

[56] References Cited

U.S. PATENT DOCUMENTS

| | | | |
|---|---|---|---|
| 296,028 | 4/1884 | Martin . | |
| 996,137 | 6/1911 | Praeger | 248/231.4 |
| 1,353,853 | 9/1920 | Sandberg . | |
| 1,852,650 | 4/1932 | Halberstadter . | |
| 1,955,476 | 4/1934 | Torgersen | 248/20 |
| 4,048,754 | 9/1977 | Laux | 47/68 |
| 4,559,738 | 12/1985 | Helfman | 47/66 |
| 4,698,936 | 10/1987 | Helfman | 47/68 |
| 5,269,095 | 12/1993 | Helfman et al. | 47/66 |
| 5,368,266 | 11/1994 | Allen | 248/231.4 |
| 5,368,267 | 11/1994 | Howard | 248/231.4 |
| 5,664,367 | 9/1997 | Huang | 47/40 |

FOREIGN PATENT DOCUMENTS

| | | | |
|---|---|---|---|
| 56023 | 10/1936 | Czechoslovakia | 47/40 |
| 211666 | 7/1908 | Germany | 47/40 |
| 494543 | 3/1930 | Germany | 47/40 |
| 67154 | 12/1943 | Norway | 47/40 |
| 172673 | 3/1934 | Switzerland | 47/40 |
| 21796 | 10/1898 | United Kingdom | 47/40 |

*Primary Examiner*—Terry Lee Melius
*Assistant Examiner*—Fredrick T. French, III
*Attorney, Agent, or Firm*—Holland & Knight LLP

[57] ABSTRACT

A planter includes a generally rectangular container having an open interior which is supported atop a wall partition, railing or the like by at least one mounting assembly comprising a base support engageable with the base of the container and a pair of identical brackets engageably slidable into contact with the sides of the wall partition or railing.

11 Claims, 3 Drawing Sheets

PLANTER

FIELD OF THE INVENTION

This invention relates to planters for plants and flowers, and, particularly, to the combination of a container and a mounting assembly capable of releasably securing the container atop a wall partition, railing, or similar structure.

BACKGROUND OF THE INVENTION

Plants and flowers have long been utilized to add a decorative and more personal atmosphere to areas in which we work and live. In an effort to intersperse plants throughout a workplace or dwelling area, and not solely along the corners or walls of the building floors, planter devices have been employed such as disclosed, for example, in U.S. Pat. Nos. 4,698,936 and 5,269,095. In one application, planters of this type are mounted atop wall partitions which extend partially upwardly from the floor toward the ceiling to define separate work areas or stations for employees. These "open plan"-type individual offices usually accommodate a desk, chair, filing cabinet or other storage cabinet leaving little space for personal decorative objects and/or plants. As such, the planters disclosed in the patents noted above allow the plant, flower or other decorative object to be located close to the employee. Additionally, it is common to find planters on railings of decks, patios, above-ground pools and indoors atop stair railings and the like. Whether at the workplace or in a dwelling, the objective of planters of this type is to take advantage of the colorful and decorative effect provided by plants and flowers and integrate that with the room environment.

A number of specific designs have been proposed for the planters described above, all of which generally comprise an elongated rectangular container having a base which is secured on the horizontal top surface of a wall partition, railing or the like by a mounting assembly. These mounting assemblies are designed to releasably and securely mount the container in place in a manner which is also aesthetically acceptable.

One mounting assembly is depicted in FIG. 2 of the drawings labeled "Prior Art" which comprises a base support A, a first L-shaped bracket B, and a second L-shaped bracket C. The base support A extends transversely along the base of the container (not shown) of the planter such that its up-turned ends D contact the container sidewalls. A threaded stud E is fixed to the bracket C which extends through an elongated slot F formed in the bracket B and, in turn, a slot G formed in the base support A. The brackets B and C are slidable with respect to one another so that their vertically downwardly extending legs can capture a wall partition, railing or other horizontal member therebetween. The container is mounted atop the base plate A, and the base plate A is secured to the brackets B and C, by a wing nut H threaded onto the stud E.

The planter mounting assembly depicted in FIG. 2 is effective to releasably secure a container atop a wall partition or the like, but it nevertheless has certain disadvantages. One limitation involves its cost. It is relatively expensive to fabricate the brackets utilized in the mounting assembly because they are very different from one another. Although both are L-shaped, bracket B is longer and is formed with slot F whereas the shorter bracket C has no slot and carries stud E. The formation of slot F and mounting of stud E require separate and different fabrication operations, which adds cost to the overall mounting assembly.

SUMMARY OF THE INVENTION

It is therefore among the objectives of this invention to provide a planter including a container and at least one mounting assembly which is capable of being mounted atop a variety of horizontally extending surfaces, which is sturdy in construction and which is comparatively inexpensive to fabricate.

These objectives are accomplished in a planter including a generally rectangular container having an open interior which is supported atop a wall partition, railing or the like by at least one mounting assembly comprising a base support engageable with the base of the container and a pair of identical brackets which are movable into contact with the sides of the wall partition or railing. An attachment device extends through the brackets and base support to secure the base support to the brackets, and to maintain the brackets in a fixed position atop the wall partition or railing.

This invention is predicated upon the concept of employing a mounting assembly having a base support and two identical brackets which rest directly atop a wall partition or railing and are slidable relative to one another along the base support. In the presently preferred embodiment, each bracket comprises a vertical leg connected at a right angle to a T-shaped horizontal leg having a head section and a narrower stem section. The stem section of each horizontal leg is insertable through a transverse slot formed at the juncture of the horizontal and vertical legs of each bracket such that when the brackets are moved toward one another against the sidewalls of a wall partition, railing or the like, the stem section of the horizontal leg of one bracket can extend through the transverse slot in the other bracket. Additionally, a longitudinally extending slot is formed in the horizontal leg of each bracket which align with the slot in the base support.

The planter of this invention is mounted on a wall partition, for example, by first extending a bolt through the slots in the bracket, and through the slot in the base support so that a portion of the threaded end of the bolt protrudes through the base support. The brackets are moved to a position relative to one another such that the wall partition is captured between the vertical legs of the brackets. A wing nut is then threaded onto the protruding section of the bolt and tightened down onto the base support. This interconnects the brackets and base support together, and clamps the entire mounting assembly in position atop the wall partition. The container rests atop the base support and is held in place by opposed, upturned ends of the base support which extend into pockets formed at the bottom of the container.

Unlike mounting assemblies of other planters, the brackets employed in this invention are identical to one another. This eliminates substantial cost in the fabrication of the mounting assemblies herein compared to the prior art wherein mounting brackets were considerably different in construction from one another and required separate machining or fabrication operations to form. Consequently, the cost of the overall planter of this invention is reduced, and inventory requirements are lessened because only one style of bracket needs to be stocked, without sacrificing the performance and versatility of the mounting assembly herein.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 4:
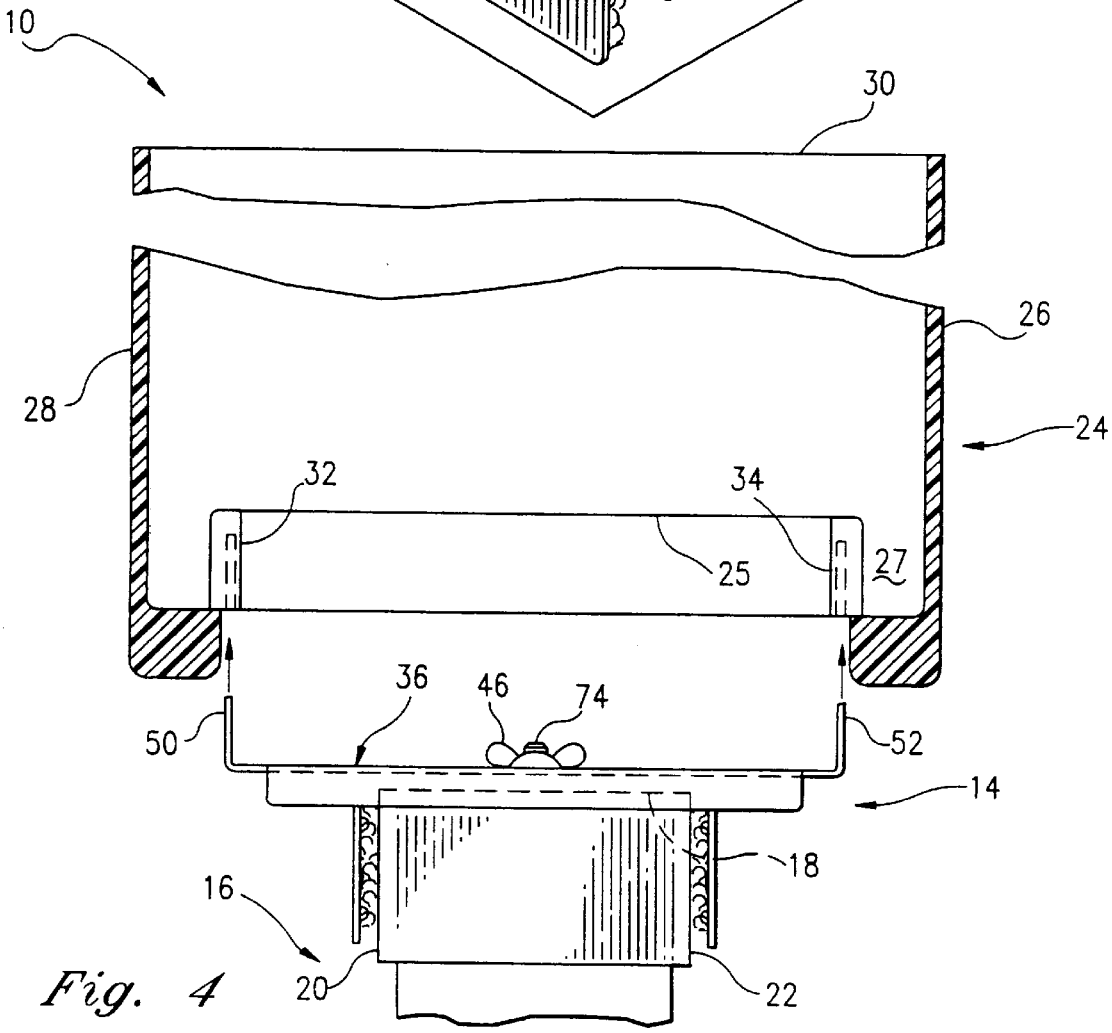
FIG. 4 is a schematic, end view of the planter of this invention in which the container is depicted in cross-section and one mounting assembly is shown in position for mounting the container to a horizontal surface.

With reference initially to FIG. 4, the planter of this invention comprises a container 10 and a mounting assembly 14 for affixing the container 10 atop a railing or partition 16. For purposes of the present discussion, a wall partition 16 is depicted in FIG. 4 having a horizontal top surface 18 and a pair of opposed sidewalls 20 and 22. It should be understood that the planter can be mounted to other horizontally oriented surfaces such as railing and the like, and the wall partition 16 is shown for purposes of illustration only.

The container 10 has a base 24, opposed sidewalls 26, 28 and opposed end walls 30, only one of which is shown, which collectively define an open interior. The base 24 of container 10 is formed with a recessed area 25 which extends into the container interior defining a channel 27 about the perimeter of the container 10 in between its sidewalls 26, 28, end walls 30 and the recessed area 25. A pair of slots or pockets 32 and 34 are formed in the base 24, at the sides of recessed area 25, for purposes to become apparent below.

Figure 1:
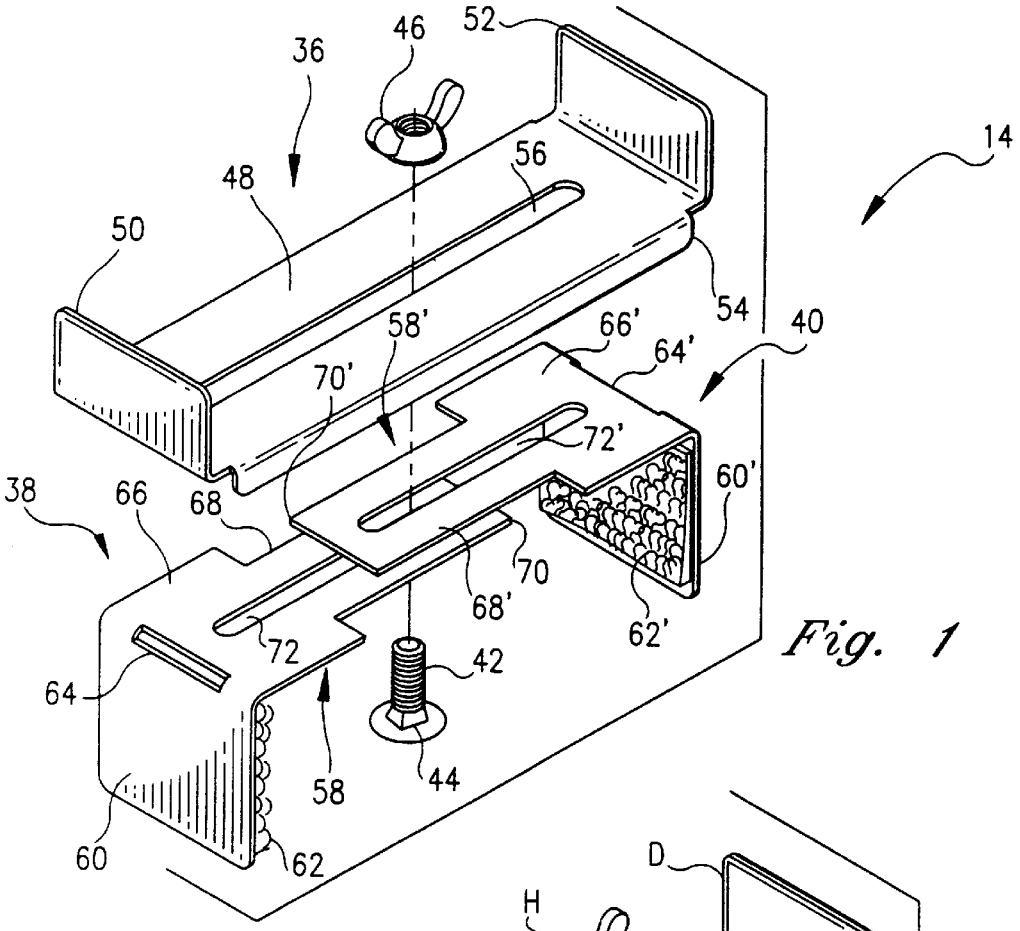
FIG. 1 is a partially exploded, disassembled view of the mounting assembly of this invention.
Figure 3:
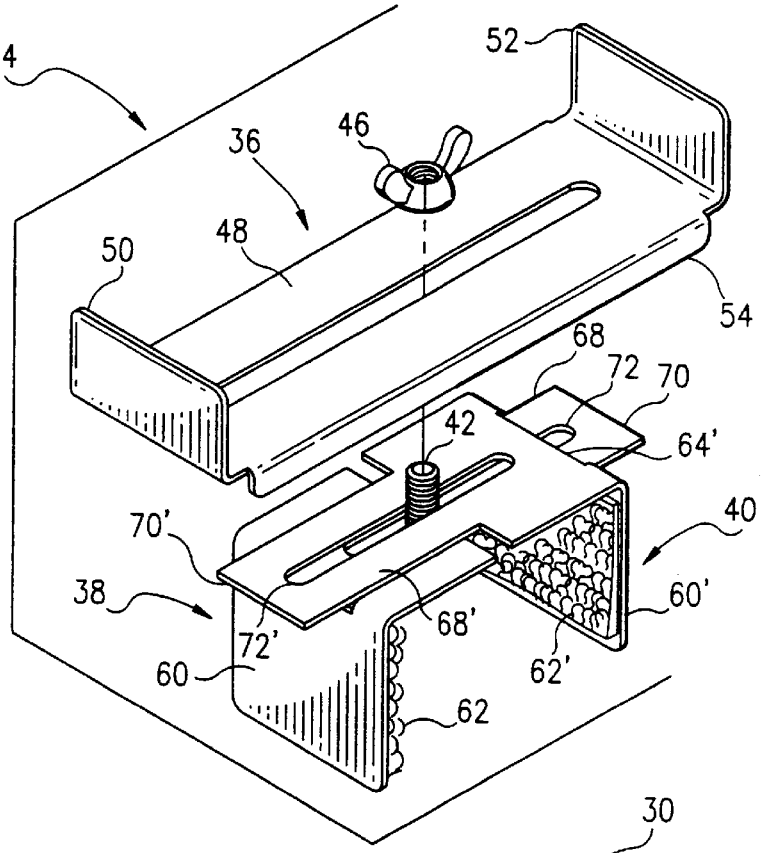
FIG. 3 is view of the mounting assembly depicted in FIG. 1 except in a partially assembled position.

Referring now to FIGS. 1 and 3, the mounting assembly 14 of this invention comprises a base support 36, a first bracket 38, a second bracket 40, and, an attachment device consisting of a bolt 42 having a squared head 44, and a wing nut 46.

In the presently preferred embodiment, the base support 36 is formed of a horizontal plate 48 having opposed, vertically upwardly extending or upturned ends 50 and 52 which are angled in a direction toward one another to releasably interlock with the slots 32, 34 in the base 24 of container 10, as discussed below. The longitudinally extending edges of horizontal plate 48 are each formed with a downwardly depending skirt 54, only one of which is shown in the Figs. Additionally, a longitudinally extending slot 56 is formed in the horizontal plate 48 between the upturned ends 50 and 52.

For purposes of the present discussion, the term "horizontal" is meant to refer to a direction parallel to the top surface 18 of wall partition 16 with the wall partition 16 is the upright position depicted in FIG. 4. The term "vertical" refers to a direction perpendicular to the horizontal direction as the mounting assembly 14 is depicted in the Figs. The terms "upwardly" and "downwardly" are used with reference to opposed directions extending toward the top and bottom of the sheets in which the Figures are drawn, respectively.

As noted above, and shown in the Figs., the first and second brackets 38 and 40 are identical to one another and for ease of description and illustration, only the detailed construction of the bracket 38 is described herein. The reference numbers utilized to identify the structure of bracket 38 are also used to reference similar structure of bracket 40 with the addition of a "'". Bracket 38 comprises a generally T-shaped horizontal leg 58 connected at a right angle to a downwardly depending vertical leg 60 having an inner surface covered with a pad 62 formed of hook or loop fastening material. A transverse slot 64 is formed at the juncture between the horizontal and vertical legs 58, 60 for purposes described in more detail below. The T-shape of the horizontal leg 58 defines a head section 66 and a narrower, stem section 68 having a leading edge 70. A longitudinally extending slot 72 is formed in the horizontal leg 58 which extends through a portion of both the head section 66 and stem section 68.

With particular reference to FIGS. 3 and 4, mounting of the planter atop the wall partition 16 proceeds as follows. The first and second brackets 38 and 40 are oriented in facing relationship, thus forming an inverted U-shape, such that the horizontal leg 58' of bracket 40 is slidable atop the horizontal leg 58 of bracket 38. In this orientation, the slots 72 and 72' of brackets 38, 40 align with one another in position to receive the bolt 42 inserted therethrough. The bolt 42 is retained in a rotatably fixed position by engagement of its squared head 44 with the slots 72, 72'. The vertical legs 60, 60' of brackets 38 and 40 depend downwardly in position to engage the opposed sidewalls 20 and 22 of the partition 16. The lateral space between vertical legs 60 and 60' is adjusted until each leg 60, 60' firmly engages a sidewall 20 or 22 of partition 16. The pads 62, 62' are helpful to help secure the vertical legs 60 and 60' in place, particularly where the sidewalls 20 and 22 of partition 16 are formed of a fabric material.

Due to the identical construction of the brackets 38 and 40, and the presence of the transverse slot 64 and 64' therein, a substantial degree of adjustment is provided in positioning the vertical legs 60, 60' relative to one another. As best shown in FIG. 3, the stem section 68 of the horizontal leg 58 of bracket 38 extends into and through the slot 64' formed in bracket 40 when it is desired to position the vertical legs 60 and 60' relatively close to one another to accommodate a comparatively thin wall partition 16. The stem section 68' of bracket 40, on the other hand, slides atop the horizontal leg 58 of bracket 38 and protrudes beyond the vertical leg 60 of bracket 38. When the thickness of the wall partition 16 requires, the respective vertical legs 60 and 60' of brackets 38, 40 are located further away from one another such as in a position depicted in FIG. 1.

The base support 36 rests atop the brackets 38, 40 such that the head sections 66 and 66' of horizontal legs 58, 58', respectively, slidably engage the opposed skirts 54 which downwardly depend from the horizontal plate 48 of base support 36. See FIG. 4. These skirts 54 help guide the transverse movement of the brackets 38, 40 toward and away from one another, and add stability to the mounting assembly 14 when the bolt 42 and wing nut 46 are secured together.

With the base support 36 in position atop the brackets 38, 40, an end 74 of the bolt 42 protrudes upwardly from the top surface of base support 36. The vertical legs 60, 60' of 38, 40 are moved into engagement with the sidewalls 20, 22 of wall partition 16, and then the wing nut 46 is threaded onto the protruding end 74 of the bolt 42 and tightened down against the base support 36. This simultaneously connects the base support 36 to the brackets 38, 40 and holds the brackets 38, 40 in a fixed position relative to one another and tightly against the sidewalls 20, 22 of partition 16.

Figure 2:
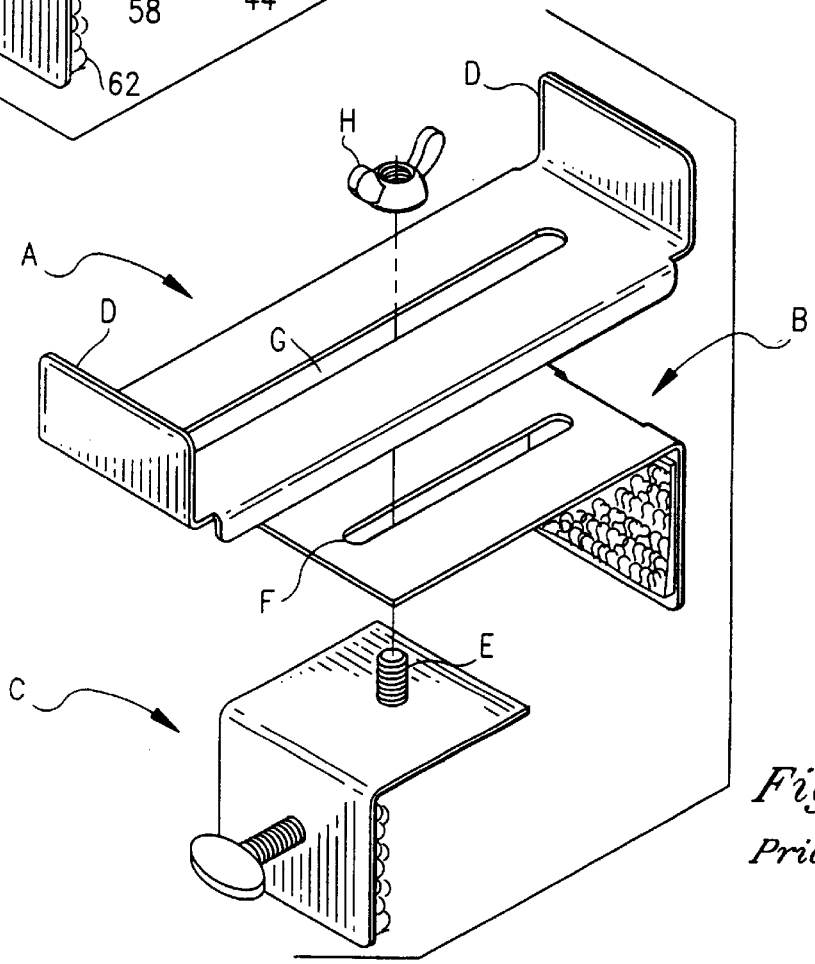
Fig. 2 Prior Art
FIG. 2 is a view similar to FIG. 1 except of a prior art mounting assembly.
Figure 5:
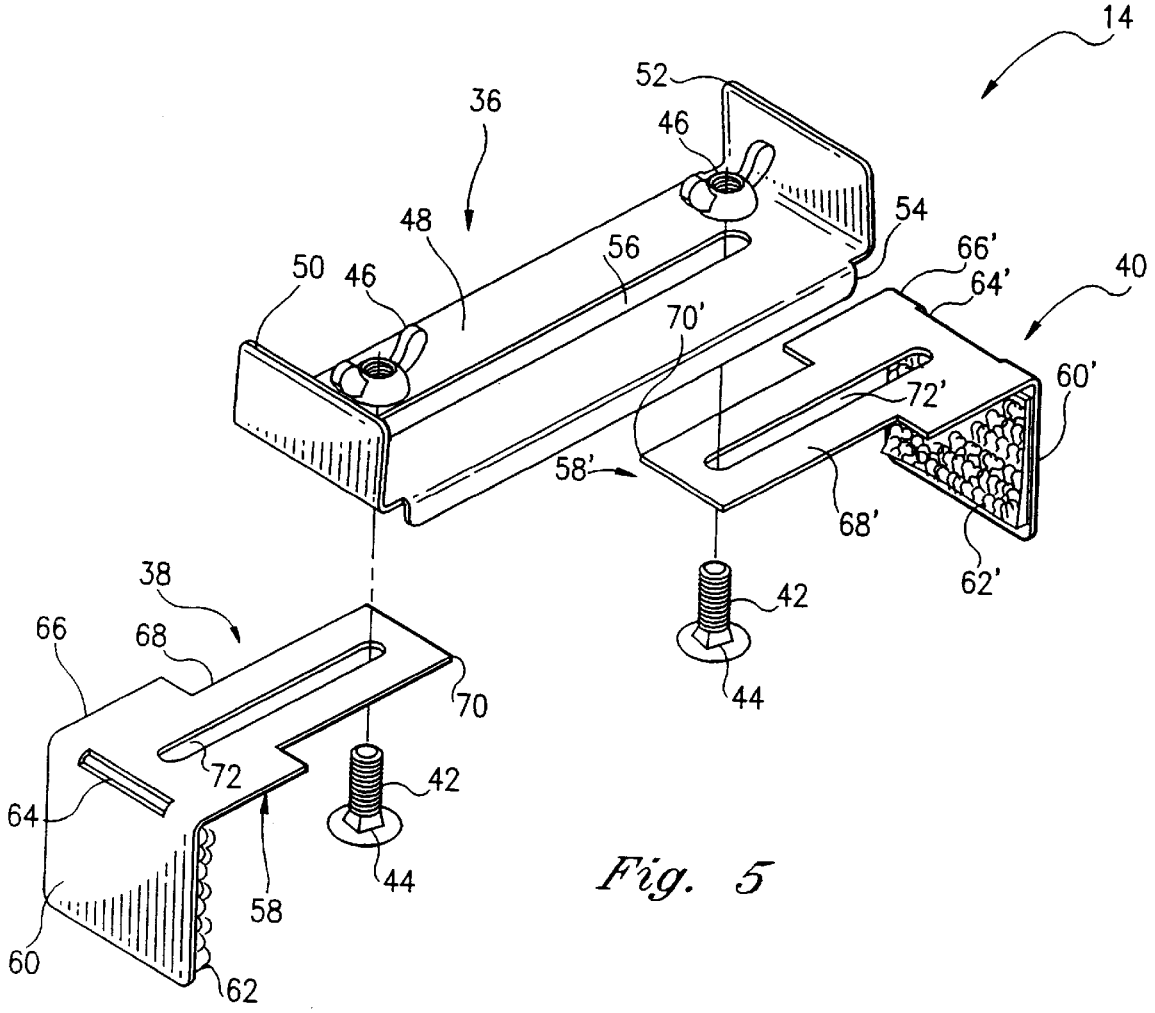
FIG. 5 is a view similar to FIG. 1, except with the mounting assembly in a fully open position.

In the embodiment of FIGS. 1–3, one bolt 42 and a wing nut 46 is employed to mount the brackets 38, 40 to the base support 36. This limits the overall width which the vertical legs 60, 60' can be separated from one another to the length of their respective slots 72, 72'. With reference to FIG. 5, the brackets 38 and 40 are shown separated from one another such that the inner edge of the slot 72 in bracket 38 aligns with the outer edge of the slot 56 in base support 36, and the inner edge of the slot 72' in bracket 40 aligns with the opposite edge of slot 56. This position represents the widest extent to which the mounting assembly 14 can be opened, accommodating wall partitions 16 up to about eight and one-eighth inches wide. In order to secure the brackets 38, 40 to base support 36, two bolts 42 and two wing nuts 46 are employed instead of just one set as in FIGS. 1–3. Of course, the brackets 38, 40 can be moved toward one another from the fully expanded position depicted in FIG. 5 to any intermediate position wherein their respective slots 72, 72' align with the slot 56 in base support 36 but not with one another. Once such slots 72, 72' do align with each other, their attachment to base support 36 is obtained as described in connection with a discussion of FIGS. 1–3.

The container 10 is retained atop the mounting assembly 14 by insertion of the upturned ends 50, 52 of base support 36 into the opposed pockets 32 and 34 formed in the container base 24. The pockets 32, 34 are positioned to snugly receive the inwardly angled, upturned ends 50, 52 of base support 36, which essentially snap-fit into the pockets 32, 34, so that the container 10 is securely mounted atop the mounting assembly 14. The recessed area 25 in the base 24 of container 10 avoids interference between the nut 46, bolt 42 or any other portion of the mounting assembly 14 and the container 10. In the event one wishes to remove the container 10 from the partition 16, the container 10 is simply lifted off the base support 36.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, while only one mounting assembly 14 is shown in FIG. 4, it should be understood that two or more mounting assemblies 14 could be utilized depending upon the size and weight of a particular container 10. In fact, it is contemplated that at least two mounting assemblies 14 would be employed for securing container 10 atop partition 16 or other horizontal surface. In that case, a like number of recessed areas 25 are formed in the base 24 of container 10.

Therefore, it is intended that the invention not be limited to the particular embodiment disclosed as the best mode contemplated for carrying out this invention, but that the invention will include all embodiments falling within the scope of the appended claims.

What is claimed is:

1. A planter for mounting atop a member having a horizontal surface extending between a pair of parallel, vertical surfaces, comprising:

a container having a base and a sidewall extending from said base which defines an open interior;

at least one mounting assembly for releasably securing said container to the member, said mounting assembly including:

(i) a base support engageable with said base of said container;

(ii) a first bracket and a second bracket each having a horizontal leg connected to a vertical leg, said horizontal legs being slidable relative to one another to position said vertical leg of each of said first and second brackets along side one of the vertical surfaces of the member, said first and second brackets being substantially identical to one another;

(iii) an attachment device for connecting said first and second brackets to said base support and for securing said first and second brackets to the vertical surfaces of the member.

2. The planter of claim 1 in which said horizontal leg of each of said first and second brackets is formed with a head section slidable along said base support and a stem section which is narrower than said head section, said vertical leg of each of said first and second brackets being formed with a transverse slot capable of receiving said stem section of said horizontal leg of the other bracket.

3. The planter of claim 2 in which said horizontal leg of each of said first and second brackets is formed with a longitudinal slot perpendicular to said transverse slot, said first and second brackets being oriented relative to one another so that said longitudinal slot in said horizontal leg of said first bracket aligns with said longitudinal slot in said horizontal leg of said second bracket.

4. The planter of claim 3 in which said base support includes a horizontal plate formed with an elongated slot oriented in alignment with said longitudinal slot in each of said first and second brackets, said attachment device including a bolt insertable through said aligning slots of said first and second brackets, and said base support, and a nut threaded onto one end of said bolt.

5. The planter of claim 1 in which said base support includes a horizontal plate formed with an elongated slot, said horizontal leg of each of said first and second brackets being formed with a longitudinal slot which align with said elongated slot in said horizontal plate without aligning with one another, said attachment device including a first bolt insertable through said aligning slots of said first bracket and said base support, a second bolt insertable through said aligning slots of said second bracket and said base support and a pair of nuts threaded onto respective bolts.

6. A planter for mounting atop a member having a horizontal surface extending between a pair of parallel, vertical surfaces, comprising:

a container having a base and a sidewall extending from said base which defines an open interior;

at least one mounting assembly for releasably securing said container to the member, said mounting assembly including:

(i) a base support engageable with said base of said container;

(ii) a first bracket and a second bracket each having a horizontal leg connected to a vertical leg, said horizontal legs being slidable relative to one another to position said vertical leg of each of said first and second brackets alongside one of the vertical surfaces of the member, said first and second brackets being substantially identical to one another;

(iii) said horizontal leg of each of said first and second brackets being formed with a head section slidable along said base support and a stem section which is narrower than said head section, said vertical leg of each of said first and second brackets being formed with a transverse slot capable of receiving said stem section of said horizontal leg of the other bracket;

(iv) an attachment device for connecting said first and second brackets to said base support and for securing said first and second brackets to the vertical surfaces of the member.

7. The planter of claim 6 in which said horizontal leg of each of said first and second brackets is formed with a longitudinal slot perpendicular to said transverse slot, said first and second brackets being oriented relative to one another so that said longitudinal slot in said horizontal leg of said first bracket aligns with said longitudinal slot in said horizontal leg of said second bracket.

8. The planter of claim 7 in which said base support includes a horizontal plate formed with an elongated slot oriented in alignment with said longitudinal slot in each of said first and second brackets, said attachment device including a bolt insertable through said aligning slots of said first and second brackets, and said base support, and a nut threaded onto one end of said bolt.

9. The planter of claim 6 in which said base of said container is formed with at least one set of opposed pockets and said base support of said at least one mounting assembly is formed with opposed, upturned ends, said upturned ends of said base support being insertable within said pockets of said base to secure said container atop said at least one mounting assembly.

10. The planter of claim 9 in which said opposed upturned ends of said base support are angled in a direction toward one another to snap fit within said pockets of said base upon insertion therein.

11. The planter of claim 6 in which said base support includes a horizontal plate formed with an elongated slot, said horizontal leg of each of said first and second brackets being formed with a longitudinal slot which align with said elongated slot in said horizontal plate without aligning with one another, said attachment device including a first bolt insertable through said aligning slots of said first bracket and said base support, a second bolt insertable through said aligning slots of said second bracket and said base support and a pair of nuts threaded onto respective bolts.

* * * * *